US005880558A

United States Patent [19]

Bauer

[11] Patent Number: 5,880,558

[45] Date of Patent: Mar. 9, 1999

[54] ELECTRODE FOR DISCHARGE LAMPS

[75] Inventor: Klaus-Dieter Bauer, Munich, Germany

[73] Assignee: Patent-Treuhand-Gesellschaft fuer elektrische Gluehlampen mbH, Munich, Germany

[21] Appl. No.: 847,547

[22] Filed: Apr. 23, 1997

[30] Foreign Application Priority Data

Apr. 24, 1996 [DE] Germany ..... 196 16 408.7

[51] Int. Cl.[6] ..... H01J 17/04

[52] U.S. Cl. ..... 313/631; 313/632; 313/633

[58] Field of Search ..... 313/630, 631, 313/632, 633, 346 R, 491

[56] References Cited

U.S. PATENT DOCUMENTS

| | | | |
|---|---|---|---|
| 4,105,908 | 8/1978 | Harding et al. | 313/631 |
| 4,210,840 | 7/1980 | Bhalla | 313/346 R |
| 4,808,883 | 2/1989 | Iwaya et al. | 313/632 |
| 5,214,351 | 5/1993 | Nieda | 313/631 |
| 5,336,970 | 8/1994 | Einbinder | 313/631 |
| 5,627,430 | 5/1997 | Kira et al. | 313/631 |

FOREIGN PATENT DOCUMENTS

| | | |
|---|---|---|
| 449117 | 4/1968 | Anguilla . |
| 0253316A2 | 1/1988 | European Pat. Off. . |

OTHER PUBLICATIONS

*Die Oxydkathode*, G. Hermann & S. Wagener,1950, pp. 137–139. No month.

*Primary Examiner*—Nimeshkumar D. Patel
*Attorney, Agent, or Firm*—Carlo S. Bessone

[57] ABSTRACT

The invention relates to an electrode for discharge lamps, with an electron emitter which contains a barium compound from the group barium zirconate ($BaZrO_3$), barium hafnate ($BaHfO_3$), barium titanate ($BaTiO_3$) and barium cerate ($BaCeO_3$) as well as one or more metallic components.

17 Claims, 1 Drawing Sheet

ELECTRODE FOR DISCHARGE LAMPS

BACKGROUND OF THE INVENTION

The invention relates to an electrode for discharge lamps. An electrode of this type, used in low-pressure discharge lamps, is, for example, described on pages 137 to 139 of the book "Die Oxydkathode" (The oxide cathode), Vol. 2 by G. Hermann and S. Wagener, Johann Ambrosius Verlag, Leipzig, 2nd Edition (1950). This electrode has a rod-shaped, doubly or triply wound electrode coil made of tungsten, which is provided with an electron emitter. In standard fashion, the electron emitter consists of a mixed oxide, which contains oxides of barium, strontium and calcium. This standard emitter is usually obtained, on activation of the electrodes fitted into the lamp, from an emitter paste with 45 mol percent barium carbonate, 45 mol percent strontium carbonate and with 10 mol percent calcium carbonate, by chemical decomposition of the carbonates into the corresponding oxides. A disadvantage with this electrode is that the emitter paste must be converted from the carbonate into the oxide, since the carbon dioxide produced in this process must be removed. Furthermore, when used in cold-starting low-pressure discharge lamps, that is to say those which strike without electrode preheating, this electrode has too short a lifetime. In addition, because of its geometry and its dimensions, this electrode coil is only partially suitable for use in T1 and T2 fluorescent lamps.

Swiss Patent CH 449 117 discloses a sintered electrode for gas discharge lamps, the electron emitter of which is produced from a mixture of metal powder with oxides or peroxides of the alkaline earth metals. This mixture preferably contains two parts of oxides or peroxides of the alkaline earth metals and one part of metal powder. It is pressed into the electrode body under high pressure, about 1000–2000 $kg/cm^2$, and then sintered. In this patent application, barium oxide is explicitly mentioned as oxide and/or peroxide, and zirconium, tantalum and tungsten are cited as metal powders. The production process for this electrode is comparatively expensive, and the electrode does not have sufficient durability in terms of cold starting. European Patent EP 0,253,316 discloses cold-startable electrodes for low-pressure discharge lamps, which essentially consists of a semiconducting porcelain. As their main component, these electrodes contain one or more oxides of the elements titanium, barium, strontium, calcium, lanthanum and tin. They furthermore have one or more additives from the group Y, Dy, Hf, Ce, Pr, Nd, Sm, Gd, Ho, Er, Tb, Sb, Nb, W, Yb, Sc and Ta. The production of these electrodes is too expensive. In addition, these electrodes are suitable only for low-pressure discharge lamps with comparatively low operating currents of up to about 50 mA, but not for operating currents of more than 100 mA, as occur in conventional fluorescent lamps.

SUMMARY OF THE INVENTION

The object of the invention is to provide an electrode for discharge lamps, which has improved durability in terms of switching and improved cold startability.

The electrode according to the invention is provided with an electron emitter which, as its main component, contains a barium compound from the group barium zirconate, barium hafnate, barium titanate and barium cerate, and furthermore has metallic additives, preferably from the group zirconium, hafnium, iron, nickel, niobium and tantalum. These barium compounds are distinguished by their high chemical stability compared to barium oxide.

Furthermore, when the electrode according to the invention is activated, there is no vigorous evolution of gas, as with the abovementioned carbonate emitter pastes, since the barium zirconate or barium hafnate or barium titanate or barium cerate does not decompose during this process. Barium zirconate $BaZrO_3$ has proved particularly advantageous. It has a high melting point (about 2700° C.) and is chemically stable, in particular with respect to air, and not hygroscopic. The metallic additives in the emitter act as reducing agents. In the barium zirconate or barium hafnate or barium titanate or barium cerate, they produce excess free metallic barium, which gives the emitter semiconducting properties and a low electron work function. In the barium zirconate, the reaction in this case proceeds according to the following scheme:

$$2\ BaZrO_3 + 1\ Me \rightarrow 2\ ZrO_2 + MeO_2 + 2\ Ba$$

The abbreviation Me in the above reaction scheme stands for zirconium or hafnium. For the metals iron, nickel, tantalum and niobium, which are likewise suitable as reducing agents, and for the other barium compounds of the emitter according to the invention, similar reaction equations can be set up.

By virtue of the excess metallic barium, the electron work function of the emitter can be lowered from about 3 eV (corresponding to the value of barium zirconate) to a value of about 2 eV. The proportion of barium zirconate in the emitter is in this case advantageously 10 mol percent to 99 mol percent, while the proportion of metallic additives is between 1 mol percent and 90 mol percent. Barium zirconate proportions of between 40 mol percent and 90 mol percent and proportions of the metallic components of the order of 20 mol percent to 50 mol percent have proved particularly good. These compositions for the emitter ensure that the abovementioned reaction takes place slowly enough to prevent premature exhaustion of the excess barium by evaporation from the electrode. The reaction rate of the reduction taking place in the abovementioned reaction scheme can also be positively influenced by adding oxides to the emitter. In some preferred illustrative embodiments of the electrode according to the invention, in order to reduce the reaction rate, zirconium dioxide and/or calcium oxide are advantageously added to the emitter. The proportion of these oxides in the electron emitter may in this case advantageously be up to 50 mol percent. In a preferred illustrative embodiment, in order to lower the electron work function further, calcium zirconate was advantageously mixed with the emitter.

In one of the illustrative embodiments, the barium zirconate was partially replaced by strontium zirconate. In this case, further to the free excess barium, free excess metallic strontium also results from the metallic reducing agent, which strontium, according to a similar reaction scheme like the one described above for barium zirconate, lowers the electron work function of the emitter and provides the emitter with semiconducting properties. The particle size of the emitter components also has an influence on the reaction, explained above, which takes place in the emitter and in which the excess metallic barium is formed. It is advantageously between 1 $\mu$m and 20 $\mu$m.

The electrode according to the invention is advantageously designed as a cold-startable cup electrode, which has a cup-like vessel with an electrical lead fastened thereon. As a result, the electrode according to the invention can also be used in T1 and T2 fluorescent lamps, the tubular discharge vessel of which has a diameter of only about ⅛ inch or ⅜ inch, i.e. 3.2 mm or 6.4 mm, and therefore cannot be fitted with the conventionally used rod coils. The electrode according to the invention is also particularly suitable for use in compact fluorescent lamps which have already become commercially available as an energy-saving replacement for all-purpose incandescent lamps. The electrodes according to the invention have high durability in terms of switching. Experiments have shown that the electrodes according to the invention withstand more than 300,000 cold starts, in which the lamp was switched on and off every 30 seconds. In the cup electrodes according to the invention, the emitter is fitted on the inner wall of the cup-like vessel or, in a particularly preferred illustrative embodiment, fills the gaps of a coil which is arranged inside the cup-like vessel. In this case, the winding axis of this coil advantageously extends parallel to the cup axis, so that the turns of the coil are tight against the inner wall of the cup. Possible blackening of the lamp bulb due to sputtering and vaporization of the emitter material is thereby minimized. The cup-like vessel of the electrode according to the invention advantageously consists of a high melting-point metal from the group niobium, tantalum, molybdenum, iron and nickel. The electrode coil arranged in the cup is advantageously made from tantalum, molybdenum or niobium.

BRIEF DESCRIPTION OF THE DRAWINGS

The invention is explained in more detail below with reference to several illustrative embodiments.

BEST MODE FOR CARRYING OUT THE INVENTION

Figure 1:
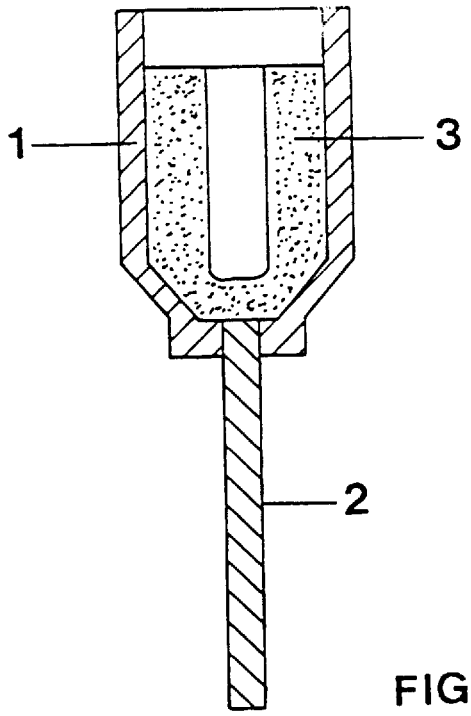
FIG. 1 shows the configuration of the electrode according to the invention according to illustrative embodiments 1 to 4.

FIG. 1 shows the structure of the electrode according to the invention corresponding to illustrative embodiments 1 to 4. These electrodes are a cup electrode for a T2 fluorescent lamp. These electrodes have a cup-like vessel 1, made of niobium, in the bottom of which an electrical lead 2 is fastened. The cup-like vessel 1 is formed from a metal sheet which is pinched over the electrical lead 2. The external diameter of the cup-like vessel 1 is about 2 mm, its height measures approximately 3.5 mm and its wall thickness is about 0.3 mm. The electron emitter 3 is arranged on the inner wall of the cup-like vessel 1.

In the first illustrative embodiment, the electron emitter 3 consists of 40 mol percent barium zirconate $BaZrO_3$ which is mixed with 30 mol percent zirconium Zr, 25 mol percent zirconium dioxide $ZrO_2$ and 5 mol percent calcium oxide CaO.

According to the second illustrative embodiment, the electron emitter 3 consists of 40 mol percent barium zirconate $BaZrO_3$ which is mixed with 20 mol percent calcium zirconate $CaZrO_3$, 20 mol percent zirconium Zr and 20 mol percent zirconium dioxide $ZrO_2$.

The electrode according to the third illustrative embodiment has an electron emitter with 50 mol percent barium zirconate $BaZrO_3$ with which 30 mol percent iron Fe and 20 mol percent niobium Nb are mixed.

In the fourth illustrative embodiment, the electron emitter of the electrode according to the invention consists of 90 mol percent barium zirconate $BaZrO_3$ which is mixed with 10 mol percent hafnium Hf.

The electrode of the fifth illustrative embodiment consists of 48 mol percent barium zirconate $BaZrO_3$ to which 17 mol percent strontium zirconate $SrZrO_3$ and 35 mol percent titanium Ti are added.

The experimentally determined electron work functions for the emitter compositions according to illustrative embodiments 1 to 5 are listed in the Table for various temperatures. The Table also contains corresponding comparison values for the standard emitter cited as the prior art.

Figure 2:
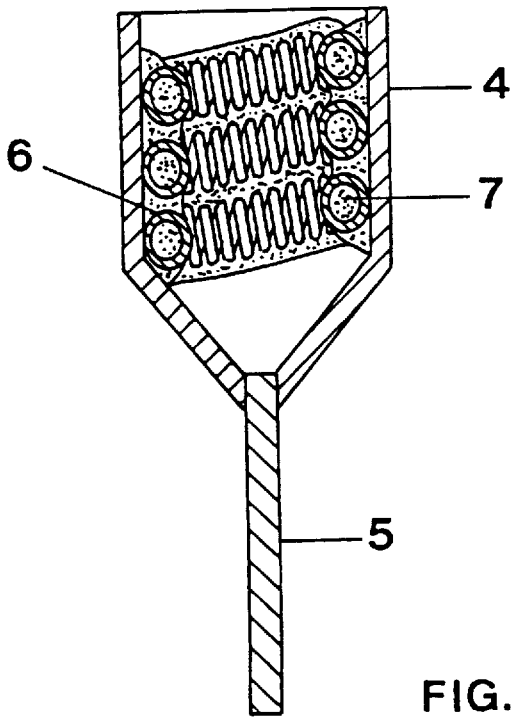
FIG. 2 shows the configuration of the electrode according to the invention according to illustrative embodiments 5 to 8.

FIG. 2 represents the structure of the electrodes according to illustrative embodiments 6 to 10. These electrodes are likewise cold-startable cup electrodes for a T2 fluorescent lamp. These electrodes have a cup-like vessel 4, consisting of niobium, in the bottom of which an electrical lead 3 is fastened. The cup-like vessel 4 is formed from an about 0.3 mm thick metal sheet which is pinched over the electrical lead 5. The external diameter of the cup-like vessel 4 is about 2 mm and its height measures approximately 3.5 mm. A doubly wound tantalum coil 6 is arranged in the cup-like vessel 4. The winding axis of this coil 6 runs coaxially with the axis of the cup. Furthermore, the turns of the coil 6 are tight against the inner wall of the cup-like vessel 4. The electron emitter 7 is arranged on the coil 6 and fills the gaps between the turns of the coil 6 and the gaps between the coil 6 and the inner wall of the cup-like vessel 4. The emitter compositions of illustrative embodiments 6 to 10 coincide with the emitter compositions of illustrative embodiments 1 to 5. The electrodes of illustrative embodiments 1 and 6, and 2 and 7, etc. thus differ only in structure and not in terms of the electron emitter.

In all the illustrative embodiments, barium zirconate $BaZrO_3$ with a particle size of about 1.2 $\mu$m was used for the electron emitter. The metallic and oxide additives were ground to a particle size of about 5 $\mu$m. In order to activate the emitter, the electrodes according to the invention were annealed under an inert gas atmosphere before they were fitted into lamps.

The invention is not restricted to the illustrative embodiments explained in detail above. By way of example, in the illustrative embodiments explained above, the cup-like vessel 1, 4 may also consist of molybdenum, tantalum, nickel or iron, and the coil 6 of molybdenum, tungsten or niobium. Further to zirconium, hafnium, niobium and iron, other suitable metallic additives for the electron emitter are nickel, tantalum, chromium, molybdenum, tungsten and vanadium. Furthermore, the barium compounds barium hafnate ($BaHfO_3$), barium titanate ($BaTiO_3$) and barium cerate ($BaCeO_3$) may also be used instead of barium zirconate ($BaZrO_3$).

TABLE

Experimentally determined electron work. functions for the emitter compositions according to the illustrative embodiments in comparison with the standard emitter

| Emitter composition according to illustrative embodiment No. | Temperature in °C. | Electron work function in eV |
|---|---|---|
| 1 and 6 | 750 | 1.96 |
| | 850 | 2.05 |
| 2 and 7 | 750 | 2.02 |
| | 850 | 2.14 |
| 3 and 8 | 850 | 2.31 |
| | 950 | 2.32 |
| 4 and 9 | 750 | 2.12 |
| | 850 | 2.20 |
| | 950 | 2.26 |

TABLE-continued

Experimentally determined electron work. functions for the emitter compositions according to the illustrative embodiments in comparison with the standard emitter

| Emitter composition according to illustrative embodiment No. | Temperature in °C. | Electron work function in eV |
|---|---|---|
| 5 and 10 | 750 | 2.06 |
| | 850 | 2.13 |
| | 950 | 2.18 |
| Standard emitter | 750 | 1.93 |
| | 850 | 2.03 |

What is claimed is:

1. An electrode for discharge lamps, with an electron emitter which contains a barium compound, characterized in that the barium compound comes from the group barium zirconate ($BaZrO_3$), barium hafnate ($BaHfO_3$), barium titanate ($BaTiO_3$) and barium cerate ($BaCeO_3$), and in that the electron emitter furthermore contains one or more metallic components and zirconium dioxide ($ZrO_2$) and/or calcium oxide (CaO).

2. The electrode according to claim 1, characterized in that the barium compound is barium zirconate ($BaZrO_3$).

3. The electrode according to claim 2, characterized in that the barium zirconate ($BaZrO_3$) is partially replaced by strontium zirconate ($SrZrO_3$).

4. The electrode according to claim 1, characterized in that the metallic components are from the group zirconium, hafnium, iron, nickel, titanium, niobium, tantalum, molybdenum, tungsten, vanadium and chromium.

5. The electrode according to claim 1, characterized in that the proportion in the electron emitter of the barium compound coming from the group barium zirconate ($BaZrO_3$), barium hafnate ($BaHfO_3$), barium titanate ($BaTiO_3$) and barium cerate ($BaCeO_3$) is 10 mol percent to 99 mol percent.

6. The electrode according to claim 1, characterized in that the proportion in the electron emitter of the metallic component or components is 1 mol percent to 90 mol percent.

7. The electrode according to claim 1, characterized in that the proportion in the electron emitter of zirconium dioxide ($ZrO_2$) and/or calcium oxide (CaO) is up to 50 mol percent.

8. The electrode according to claim 5, characterized in that the proportion in the electron emitter of the barium compound coming from the group barium zirconate ($BaZrO_3$), barium hafnate ($BaHfO_3$), barium titanate ($BaTiO_3$) and barium cerate ($BaCeO_3$) is 40 mol percent to 90 mol percent.

9. The electrode according to claim 6, characterized in that the proportion in the electron emitter of the metallic component or components is 20 mol percent to 50 mol percent.

10. The electrode according to claim 1, characterized in that the emitter components have a particle size of between 1 $\mu$m and 20 $\mu$m.

11. The electrode according to claim 1, characterized in that the electrode is a cup electrode which has a cup-like vessel (1, 4) and an electrical lead (2, 5) fastened thereon.

12. The electrode according to claim 11, characterized in that the cup-like vessel (1, 4) consists of a metal from the group niobium, tantalum, iron, nickel and molybdenum.

13. The electrode according to claim 11, characterized in that the electron emitter (3, 4) is arranged on the inner wall of the cup-like vessel (1,4).

14. The electrode according to claim 11, characterized in that the electrode has an electrode coil (6) which is arranged inside the cup-like vessel (4), the electron emitter (7) being arranged on the electrode coil (6) and/or in the gaps between the electrode coil turns.

15. The electrode according to claim 14, characterized in that the electrode coil (6) is tight against the inner wall of the cup-like vessel (4) and the winding axis of the electrode coil (6) is parallel to the cup axis.

16. The electrode according to claim 14, characterized in that the electrode coil (6) consists of a metal from the group tantalum, niobium, tungsten and molybdenum.

17. An electrode for discharge lamps, with an electron emitter which contains a barium compound, characterized in that the barium compound comes from the group barium zirconate ($BaZrO_3$), barium hafnate ($BaHfO_3$), barium titanate ($BaTiO_3$) and barium cerate ($BaCeO_3$), and in that the electron emitter furthermore contains one or more metallic components and calcium zirconate ($CaZrO_3$).

* * * * *